US005784007A

United States Patent [19]

Pepper

[11] Patent Number: 5,784,007

[45] Date of Patent: Jul. 21, 1998

[54] TRAFFIC SIGNAL SOUND MONITOR

[76] Inventor: Jeffrey W. Pepper, P.O. Box 68, Tallahassee, Fla. 32302

[21] Appl. No.: 313,337

[22] Filed: Sep. 27, 1994

[51] Int. Cl.[6] ..... G08G 1/00

[52] U.S. Cl. ..... 340/933; 340/436; 340/902; 340/906; 364/424.04

[58] Field of Search ..... 340/933, 905, 340/907, 909, 910, 916, 917, 919, 943, 937, 906, 429, 436, 566, 439, 902; 364/436, 424.03, 424.04, 461; 116/63 R; 180/167; 367/197–199

[56] References Cited

U.S. PATENT DOCUMENTS

| | | | |
|---|---|---|---|
| 3,866,165 | 2/1975 | Maronde et al. | 340/937 |
| 3,895,344 | 7/1975 | Gill, Jr. et al. | 340/943 |
| 3,992,656 | 11/1976 | Joy | 361/182 |
| 4,279,027 | 7/1981 | Van Sloun | 367/125 |
| 4,759,069 | 7/1988 | Bernstein et al. | 381/56 |
| 4,775,865 | 10/1988 | Smith et al. | 340/906 |
| 4,806,931 | 2/1989 | Nelson | 340/907 |
| 4,864,297 | 9/1989 | Shaw et al. | 340/902 |
| 5,446,659 | 8/1995 | Yamawaki | 364/424.03 |

*Primary Examiner*—Jeffery Hofsass
*Assistant Examiner*—Davetta Woods

[57] ABSTRACT

A means for recording the status of a traffic regulating device upon the occurrence of a vehicle collision. Sounds are detected by microphone (10), register on decibel meter (20) and are input to microprocessor (40). The microprocessor (40) simultaneously inputs data from a clock (30) and a signal monitor (50) which continuously reads the status of the lamps of the traffic signal (60). The microprocessor (40) continuously calculates the duration of status of each lamp of the traffic signal (e.g., how long the red light has been "on"). If the sound level registering on the decibel meter (20) exceeds a certain threshold, the microprocessor (40) then transmits the time, lamp status and duration of the lamp status to the hard disk (70), which records this data. Said data can be retrieved from the hard disk (70) by using the keyboard (80) to input a request to the microprocessor (40) which will output the data to the television monitor display (90). Thus, knowing the status of the traffic lamps and the duration of that status, an investigator can determine which vehicle involved in the collision entered the intersection while facing a red light, causing the collision.

3 Claims, 2 Drawing Sheets

10
20
DECIBEL METER
30
CLOCK
40
CENTRAL PROCESSING UNIT (MICROPROCESSOR)
50
60
61
62
63
HARD DISK STORAGE DEVICE
70
90
DISPLAY MONITOR
80

TRAFFIC SIGNAL SOUND MONITOR

BACKGROUND

Field of Invention

This invention is an improvement to traffic signal devices to help determine fault in vehicle accidents.

OBJECTS AND ADVANTAGES

It is often very difficult to determine fault in traffic accidents. Most intersection collisions occur because one party fails to yield the right of way. Often, the crucial issue is the status of the traffic lights when each vehicle entered the intersection.

Each party involved in a collision may claim "I had the green light." If the status of the traffic lights at the time of the collision could be determined, it could resolve the frequent question of "who ran the red light?" and caused the accident.

It is possible to place a video or other camera at each signalized intersection and continuously videotape the traffic. Besides being very expensive, one camera could probably not give a wide enough view to catch each accident on tape or get a sufficient view of the subject vehicles or the status of the traffic lights.

There are other practical shortcomings to such visual methods such as high maintenance and repair costs, easy theft or vandalism, time limitations for video tapes, tape wear playback and display difficulties, mechanical parts with relatively high breakdown rates, lighting requirements, weatherproofing requirements, etc.

A much better idea is to use a listening device to detect sounds which are associated with a traffic accident.

A vehicle collision produces an unusual noise event which is characterized by extraordinary sound characteristics (e.g., an unusual decibel level or sound wave frequency). An appropriate sound monitoring device or combination of devices, such as a decibel meter, glass-break detector, or both, would be able to detect one or more of the noise characteristics which are produced by a collision. By using such a sound monitoring device in conjunction with a traffic signal, the status of the red, yellow and green lamps could be recorded as of the time that the noise event (b the collision) occurs.

If a noise characteristic exceeded a certain threshold the sound monitoring device would cause the time, sound level and traffic by a central processing unit signal status to be recorded by a central processing unit. It would also be very helpful to record the duration of the lamp status (e.g., how long the red and possibly the sound of the collision itself. light had been "on") and possibly the sound of the collision itself.

By selecting appropriate sound thresholds, there should be very few entries in the record. While there might be a few false signals (e.g., a screech of tires which did not result in an accident), these should be relatively rare. The threshold should be set (perhaps using more than one sound characteristic) so that any actual collision would surely be recorded while other noise events would not generally trigger the system.

Even if the system were fairly sensitive, resulting in several false signals per day, it should be simple to isolate the noise event associated with a particular accident.

An investigating officer would simply display and review the noise events which were recorded by the sound monitor system during the period of time relevant to the accident. The time of occurrence should make it obvious which noise event was associated with this particular accident. The officer would then have a record of the status of the traffic signal lights at the time of the noise event (the collision). The recording device should also record and display the duration of each signal condition (e.g., how long the red light had been on). With this information the investigator would be able to determine to a near certainty which car entered the intersection properly under the green light.

SUMMARY OF PATENT

The idea for this patent is to use, in combination, a means for detecting the sound characteristics associated with a vehicle collision and a means for recording the status of a traffic regulating device, in order to determine the status of said traffic regulating device upon the occurrence of a vehicle collision.

One method to accomplish this purpose is as follows:

A listening device (e.g., microphone) would be attached to a sound monitoring device (e.g., decibel meter) which could detect one or more characteristics of the sounds heard by the listening device. The sound monitoring device (the "sound monitor") would be selected to detect those noises which are associated with automobile collisions. The sound monitor would be connected to a central processing unit (CPU). Also connected to the CPU would be a device which continuously monitors the status of the traffic signal (i.e., which red, yellow and green lamps were illuminated at that moment). A clock, a data recording device and an output display would also be connected to the CPU.

The CPU would continuously input the status of the traffic signal, the clock, and the sound monitor. The CPU would store the status of each traffic lamp and update each change in the status of the lamps. When the status of a lamp changes, the CPU would input and store the time of the change. The CPU would continuously calculate the duration of the lamp status.

An unusual noise event would cause the sound monitor to exceed a predetermined threshold. When such a noise event was detected by the sound monitor, the system would instantly record the time (and date) of the occurrence. The CPU would be triggered to simultaneously record the status of the traffic signal and the duration of that status.

The CPU would display the recorded information so that it would be accessible to investigating authorities. The investigating officer would determine the time of a collision by independent means. The officer could simply check the log of noise events recorded by the CPU to determine the illumination status of the traffic lamps when the collision occurred and the length of time that the lamps had been in that state of illumination.

DRAWING FIGURES

The attached drawings illustrate one of many possible ways to implement this invention.

REFERENCE NUMBERS IN DRAWINGS

10 Microphone
20 Decibel Meter
30 Electronic Clock ("Clock")

40 Central Processing Unit of Microprocessor ("CPU")
50 Signal Monitor
60 Traffic Signal
61 Red Lamp
62 Yellow Lamp
63 Green Lamp
70 Hard Disk Storage Device ("Hard Disk")
80 Keyboard
90 Television Monitor ("Display")

DESCRIPTION AND OPERATION

Figure 1:
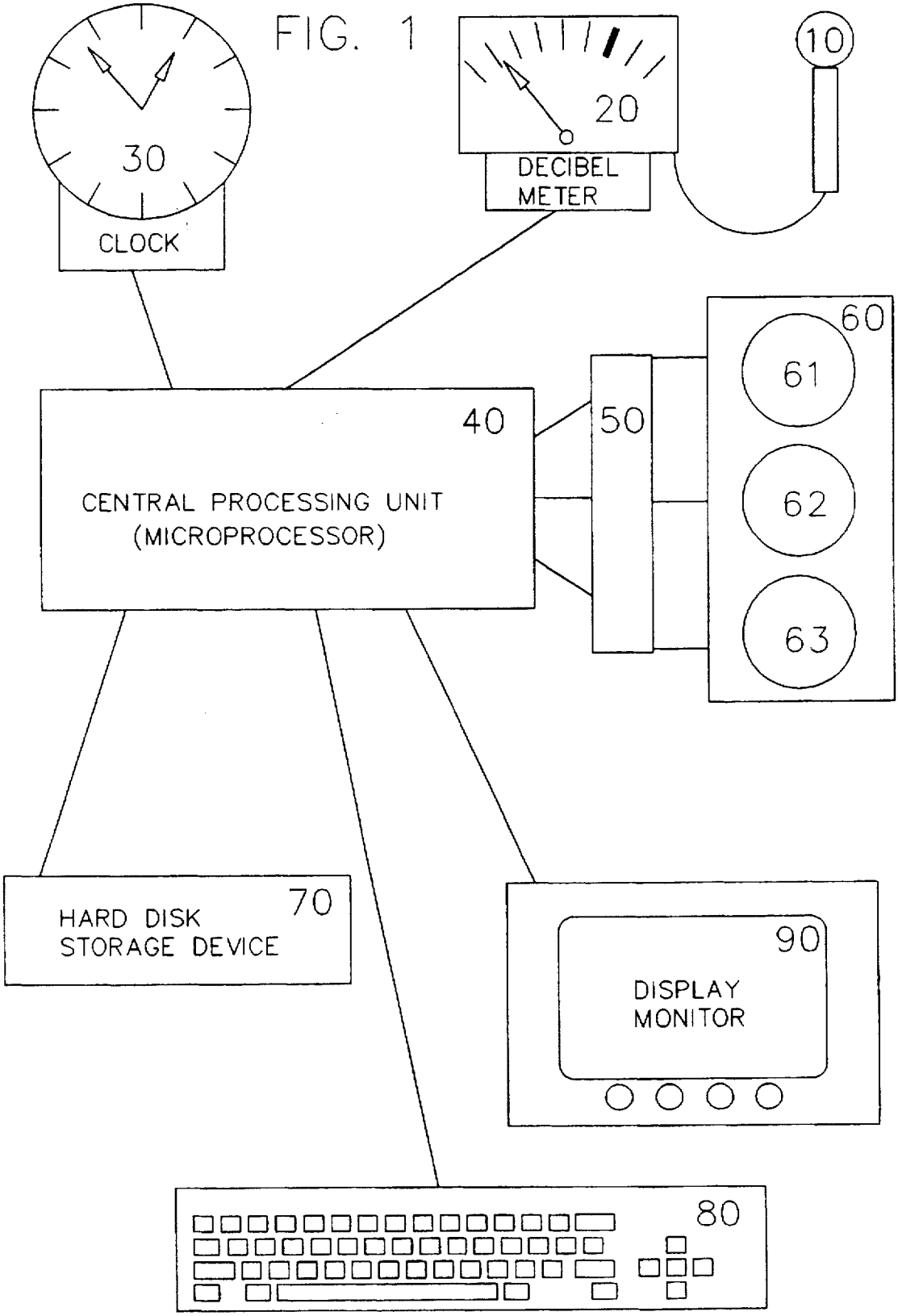
FIG. 1 shows a schematic design of possible implementation of this invention.
Figure 2:
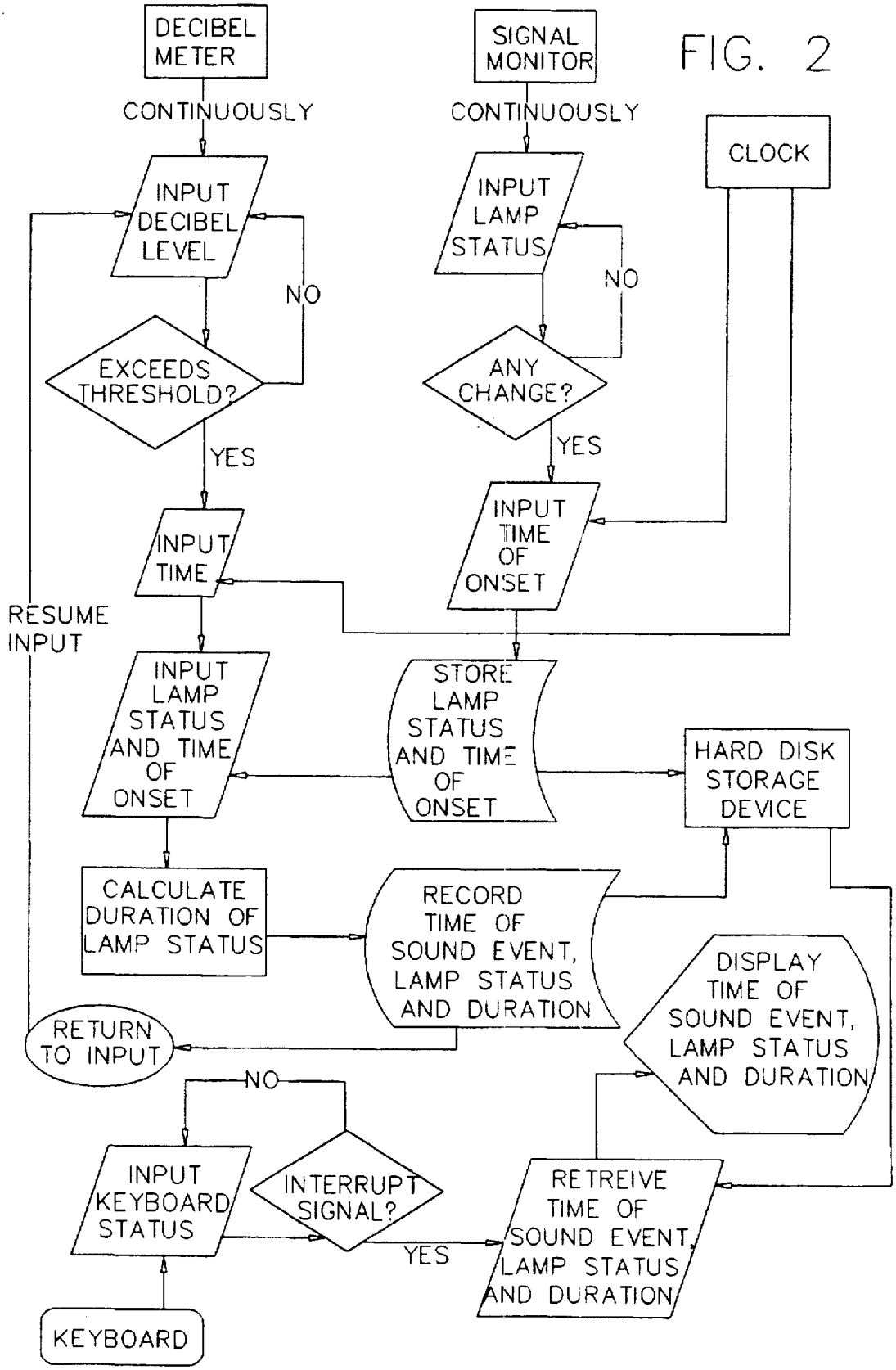
FIG. 2 shows a flow chart of one possible program to operate the central processing unit involved.

Microphone 10 is connected to Decibel Meter 20 which is connected to the Central Processing Unit ("CPU") 40 of a microprocessor. CPU 40 is connected to Hard Disk Storage Device 70 ("Hard Disk"). Traffic Signal 60 is mounted above a street intersection and contains Red Lamp 61, Yellow Lamp 62 and Green Lamp 63 (the "Lamps"), which are turned on and off by Traffic Signal 60 to regulate traffic flow at the intersection. Traffic Signal 60 is connected to Signal Monitor 50 which is connected to CPU 40. Clock 30 is connected to CPU 40. Display 90 and Keyboard 80 are connected to CPU 40. CPU 40 is controlled by the Program (see flow chart—FIG. 2). All of the described connections are through customary electronic wiring, but connection by radio transmission would also work.

Signal Monitor 50 continuously reads and transmits to CPU 40 the electronic status of Traffic Signal 60. That is, Signal Monitor 50 reads the on-off status of the Lamps 61–63 in Traffic Signal 60. The status of Lamps 61–63 is continuously sent to CPU 40 as input data. The time is continuously transmitted from Clock 30 to CPU 40 as input data. The Program written for CPU 40 uses the data input from Clock 30 and from Signal Monitor 50 to calculate continuously the duration of the status of Lamps 61–63 in Traffic Signal 60. Thus, CPU 40 registers whether each Lamp is on or off (the "Lamp Statuse"), when it entered that state (the "Time of Onset"), and then calculates how long it has been in that state (the "Duration").

When two vehicles collide at the intersection which is regulated by Traffic Signal 60, the noise of the collision is picked up by Microphone 10. The sound level registers on Decibel Meter 20 and is transmitted to CPU 40 as input data. If the sound level exceeds a threshold, the Program instructs CPU 40 to transmit to Hard Disk 70 the time of day, the Lamp Status and the Duration which is recorded as of the moment that the noise event from the collision was detected. This data can then be retrieved by an investigator using Keyboard 80 to transmit his request to CPU 40, which would access the stored information from Hard Disk 70 and display the information on Display 90 (see Program flow chart—FIG. 2).

CONCLUSION AND DISCUSSION

It must be emphasized that any instrument capable of detecting relevant sounds and sound characteristics could be used in place of the microphone. Any device which is capable of measuring relevant sound characteristics, such as decibel level, sound wave frequency or amplitude, duration of levels, or combinations of relevant factors, could be used as a sound monitor in place of the decibel meter. Any device which can detect the status of the traffic signal, whether directly wired to the traffic signal, or using sensors or otherwise, could be used as a signal monitor. Any central processing unit capable of reading, storing and/or recording the relevant inputs could be substituted for the microprocessor-based CPU. Any timing device could substitute for the clock. Any data storage device could substitute for the hard disk drive. And any input and display devices could substitute for the keyboard and monitor. The scope of the invention should be determined by the appended claims and their legal equivalents, rather than by the example given.

The essential element of this invention is that the sounds characteristic of an automobile collision will be detected by a device connected to a traffic signal, so that the status of the traffic signal lamps can be determined as of the time of the collision. Any implementation of this invention which could detect accident noises and simultaneously record the lamp status of a traffic signal would allow accident investigators to determine "who ran the red the light?" This would be an invaluable tool to help find the guilty party, but much more importantly, to exonerate the innocent.

I claim:

1. A device to help determine fault in a vehicle collision comprising: a microphone to detect the sounds of a vehicle collision; a sound measuring device to determine the wavelength and/or intensity of the detected sounds; a filter to eliminate all sounds except those associated with a vehicle collision, in order to distinguish those sound events which are associated with a vehicle collision; a microprocessor to record the sound events which pass through the filter while simultaneously monitoring the status of a traffic signal while simultaneously monitoring the status of a clock, so that said microprocessor may record the beginning time of a change in the status of said traffic signal and the time of occurrence of each sound event associated with a vehicle collision, so that said microprocessor may record the beginning time of the change in status of said traffic signal and the time of said vehicle collision, and may calculate the duration of the status of said traffic signal; and a display device to output the recorded sound event, the time of said sound event, and the duration of the status of said traffic signal at the time of said sound event; whereby an investigating officer may determine the time of a vehicle collision, the status of the traffic signal at the time of the collision, and the duration of said status at the time of the collision.

2. The invention of claim 1 wherein the sound measuring device includes a decibel meter.

3. The invention of claim 1 wherein a disk storage device is used to record and store data output from said microprocessor.

* * * * *